US007377409B1

(12) United States Patent
Brown

(10) Patent No.: US 7,377,409 B1
(45) Date of Patent: May 27, 2008

(54) VICTORIAN EAGLE ORGANIZER

(76) Inventor: Michael E. Brown, P.O. Box 964, West Rutland, VT (US) 05777

( * ) Notice: Subject to any disclaimer, the term of this patent is extended or adjusted under 35 U.S.C. 154(b) by 153 days.

(21) Appl. No.: 11/076,776

(22) Filed: Mar. 11, 2005

(51) Int. Cl.
*A41D 27/22* (2006.01)

(52) U.S. Cl. ..... 223/88; 223/85; 223/97; 223/DIG. 1; 211/85.2

(58) Field of Classification Search ..... 223/85, 223/87, 88, 91, 92, 93, 95, 96, 97, DIG. 4, 223/DIG. 1; 211/85.2, 85.3, 118; D6/315, D6/316, 318, 319, 328
See application file for complete search history.

(56) References Cited

U.S. PATENT DOCUMENTS

| | | | | | |
|---|---|---|---|---|---|
| 884,616 | A | * | 4/1908 | Schlang | 223/86 |
| 884,617 | A | * | 4/1908 | Schlang | 223/86 |
| 1,176,563 | A | * | 3/1916 | Johnson | 211/196 |
| 1,358,756 | A | * | 11/1920 | Kozlowski | 211/163 |
| 1,421,614 | A | * | 7/1922 | Taubman | 223/92 |
| 1,515,600 | A | * | 11/1924 | Kornas | 223/86 |
| 1,591,786 | A | * | 7/1926 | Simpson | 223/88 |
| 1,658,882 | A | * | 2/1928 | Cantrell et al. | 248/407 |
| 1,911,208 | A | * | 5/1933 | Max et al. | 223/86 |
| 1,914,840 | A | * | 6/1933 | Wolff | 223/88 |
| 1,943,745 | A | * | 1/1934 | Sanford | 223/88 |
| 1,991,987 | A | * | 2/1935 | Smith | 223/91 |
| 2,116,156 | A | * | 5/1938 | Morgan | 223/88 |
| 2,151,964 | A | * | 3/1939 | Gay | 223/85 |
| 2,198,768 | A | * | 4/1940 | Goldman | 223/88 |
| D128,789 | S | * | 8/1941 | Rhodes | D6/319 |
| D136,082 | S | | 8/1943 | Schreiber | |
| D138,063 | S | * | 6/1944 | Burr | D6/414 |
| 2,383,593 | A | | 8/1945 | Deerfsun | |
| D146,262 | S | * | 1/1947 | Mack, Sr. | D6/319 |
| D149,517 | S | * | 5/1948 | Read | D6/319 |
| 2,492,287 | A | * | 12/1949 | Hogan | 223/93 |
| 2,499,538 | A | * | 3/1950 | Stanton | 223/88 |
| 2,509,346 | A | * | 5/1950 | Hustede | 223/91 |
| 2,587,743 | A | * | 3/1952 | MacKey | 223/88 |
| 2,615,602 | A | * | 10/1952 | Thompson et al. | 223/87 |
| D179,745 | S | * | 2/1957 | Snook | D6/319 |
| 2,829,810 | A | * | 4/1958 | Wilson | 223/88 |
| 2,875,932 | A | * | 3/1959 | Scott | 223/91 |
| 3,081,881 | A | * | 3/1963 | Seeger | 211/85.3 |

(Continued)

FOREIGN PATENT DOCUMENTS

EP 588207 A2 * 3/1994

*Primary Examiner*—Gary L. Welch
*Assistant Examiner*—Nathan E Durham
(74) *Attorney, Agent, or Firm*—Patent & Trademark Services, Inc; Joseph H. McGlynn

(57) ABSTRACT

An organizer for holding a variety of items in one location having a body with a hook shaped upper portion, for hanging the organizer on a support, and a neck portion. The neck portion having an aperture extending therethrough for receiving items, and a line extending from a portion of the body adjacent the aperture for securing items extending through the aperture, and a second hook shaped portion extending from the top of the hook shaped upper portion, and the hook shaped upper portion has a third hook shaped portion extending from a side portion below the second hook shaped portion, and the hook shaped upper portion, the second hook shaped portion, and the third hook shaped portion each have an aperture extending therethrough.

3 Claims, 3 Drawing Sheets

U.S. PATENT DOCUMENTS

D202,954 S * 11/1965 Hanson ..... D6/318
3,249,270 A * 5/1966 Zuckerman ..... 223/91
3,406,882 A * 10/1968 Phillips ..... 223/88
3,592,343 A * 7/1971 Swett et al. ..... 211/123
3,741,449 A * 6/1973 MacKenzie ..... 223/91
3,783,995 A * 1/1974 Tobin ..... 206/232
D243,055 S * 1/1977 Blumberg ..... D6/315
D247,084 S * 1/1978 De Mascole et al. ..... D6/315
4,109,838 A * 8/1978 Dwek ..... 223/91
D276,673 S * 12/1984 Ritchey ..... D6/327
D279,627 S * 7/1985 Morin ..... D6/319
4,703,878 A * 11/1987 Louw ..... 223/95
4,830,237 A * 5/1989 Louw ..... 223/89
4,966,287 A * 10/1990 Snyder ..... 211/85.2
D323,755 S * 2/1992 Harney ..... D6/513
D342,612 S * 12/1993 McIntyre ..... D6/315
5,427,230 A * 6/1995 Mattox ..... 206/6.1
D367,985 S * 3/1996 Hale ..... D6/514
5,526,968 A * 6/1996 Larson ..... 223/88
5,934,524 A * 8/1999 Gray ..... 223/85
5,971,237 A * 10/1999 Timbrook ..... 223/85
6,036,064 A * 3/2000 Tawil ..... 223/88
6,196,396 B1 * 3/2001 Bennett ..... 211/85.3
6,398,086 B1 * 6/2002 Bennett ..... 223/87
6,688,503 B2 * 2/2004 Viazanko et al. ..... 223/89
6,808,064 B1 * 10/2004 Fanning ..... 206/286
2004/0182892 A1 * 9/2004 Carty ..... 223/88

* cited by examiner

VICTORIAN EAGLE ORGANIZER

BACKGROUND OF THE INVENTION

This invention relates, in general, to organizers, and, in particular, to an organizer which will hold a variety of items.

DESCRIPTION OF THE PRIOR ART

In the prior art various types of organizers have been proposed. For example, U.S. Pat. No. Des 136082 to Schreiber discloses a hanger with a plurality of hooks to hold different types of clothing items.

U.S. Pat. No. Des 149517 to Read discloses a hanger with a plurality of hooks to hold different types of clothing items.

U.S. Pat. No. 2,383,593 to Deerfsun discloses a hanger shaped like a swan and which has a plurality of slots and apertures.

U.S. Pat. No. 2,492,287 to Hogan discloses a hanger with a plurality of slots.

SUMMARY OF THE INVENTION

The present invention is directed to an organizer which has a plurality of hooks, apertures and slots which allow the user to secure a variety of possessions in one place.

It is an object of the present invention to provide a new and improved organizer which can be used to hold a variety of items.

It is an object of the present invention to provide a new and improved organizer which can be mounted on a vertical or horizontal surface.

It is an object of the present invention to provide a new and improved organizer which can be made from recycled materials and in different colors.

These and other objects and advantages of the present invention will be fully apparent from the following description, when taken in connection with the annexed drawings.

DESCRIPTION OF THE PREFERRED EMBODIMENT

Figure 1:
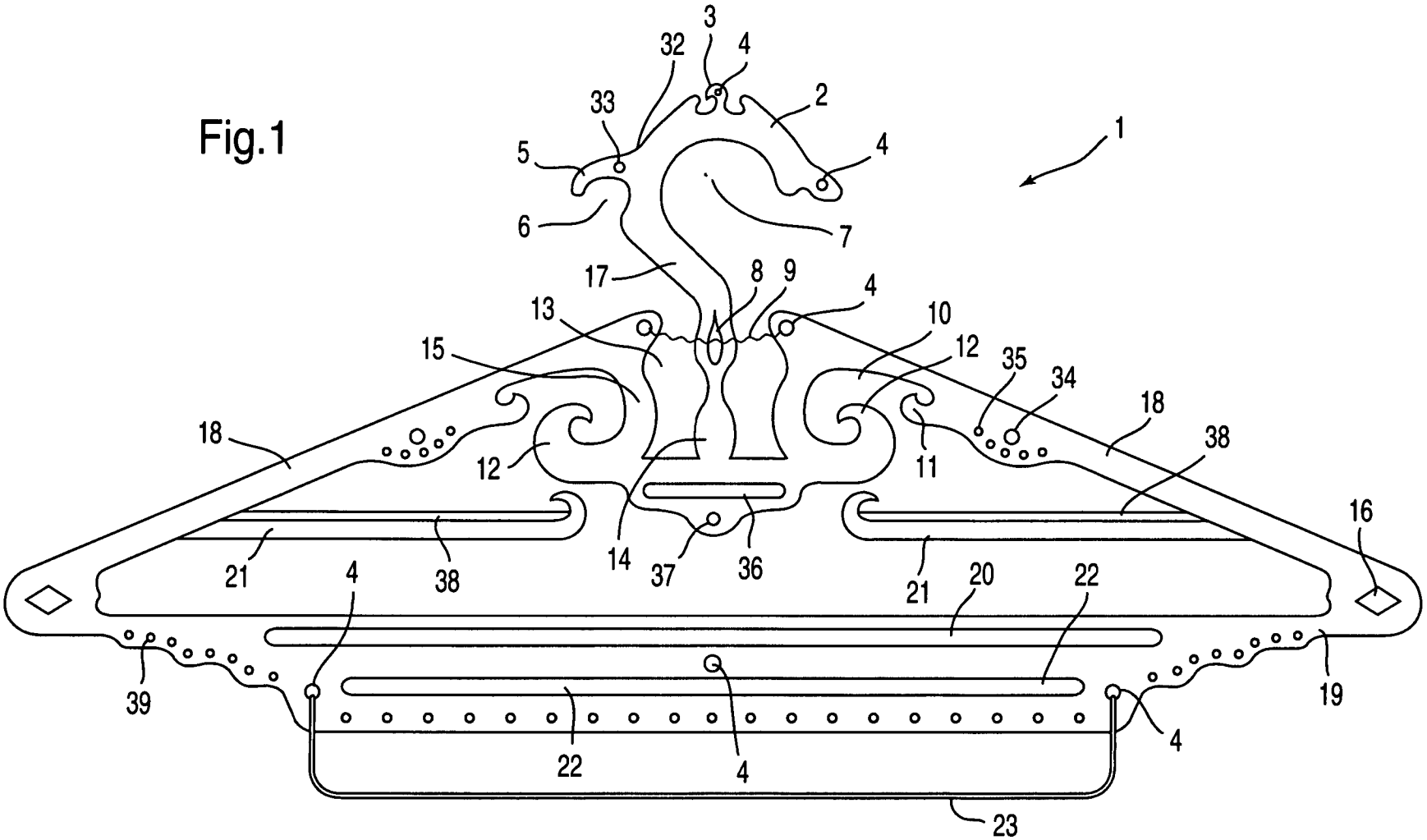
FIG. 1 is a front view of the present invention.

Referring now to the drawings in greater detail, FIG. 1 shows the organizer 1 of the present invention. The organizer 1 is shaped similar to a clothes hanger and has a hook 2 along with a concave area 7 that can be used to hang the organizer 1 on a vertical surface through the use of a conventional hanger apparatus such as those used to hang pictures on a wall. The organizer 1 can also be hung on a horizontal surface such as a clothes rod. It should be noted that the above examples are merely examples and not an all inclusive list of the hanging possibilities. Essentially any type of hanger can be used to mount the organizer 1 on any vertical or horizontal surface.

The hook 2 has another hook 3 with an aperture 4 extending therethrough. A flexible line such as a fishing line can be passed through the aperture 4 to suspend the organizer on a support. The top of the hook 2 has a contour at 32 for receiving a user's thumb for holding the organizer when the user is placing the organizer on a support. A third hook 5 along with concave portion 6 forms another hanging portion for the organizer. The three hooks 2, 3, 5 provide versatility when hanging the organizer 1 from a variety of supports. If the organizer can not be hung easily from a support using hook 2, perhaps it can be hung easier using hook 3 or hook 5. Also, the hook 5 can be used to hold the organizer when a user is trying to place the hook 2 or the hook 3 over a support.

Neck portion 17 of the organizer has an aperture 8 which can be used to secure items such as eyeglasses, necklaces, or jewelry by passing a portion of the item through the aperture and letting the rest of the item drape over the solid portion of the aperture. A flexible line such as the line shown at 9 can be attached to the apertures 4 as shown in FIG. 1 to help secure the items to the organizer. The aperture 8 can also be used to secure a plurality of organizers 1 together by passing any conventional fastener through the aligned apertures 8 on the plurality of organizers.

An aperture 33 (adjacent hook 5) extends through the organizer 1 and can also be used instead of aperture 8, or in addition to aperture 8, to secure two or more organizers 1 together. A line, such as the line 9 can be used to secure the organizers together.

Lower neck area 14 can be used to secure scarves, ties and the like by wrapping them around area 14 (or between 14 and 15) and passing them through the slots 13 on opposite sides of area 14. The line 9 will also help to hold the scarf or tie. In addition, jewelry and other flexible items can be draped over line 9.

The arms 18 have a gentle slope and will hold any item that can be draped over the arms. The apertures 34 in each arm 18 can be used to secure cufflinks or necklaces passed through the apertures. The hook shaped portions 11, 12 and the slots 10 can be used to hold watches, bracelets, rings, and eyeglasses, among other similar items. Apertures 35 in each arm 18 can be used to hold items such as earrings. Slot 36 (below lower neck area 4) can be used for items such as ties, bras, necklaces, nylons, etc. Aperture 37 (below slot 36) can be used to hold a hearing aid case holder. Arms 21 (beneath arms 18) can be used to hold socks, watches, rings, hoops, etc. The top of each arm 21 can have a surface texture 38 applied thereto. The surface texture 38 can be any conventional surface texture that will stop items from sliding along the surface of arm 21 if the organizer 1 is moved, holding jewelry horizontally.

The organizer has a bottom arm 19 that is secured to each of the side arms 18. The bottom arm 19 can be unitary with arms 18 or can be integral with arms 18 and secured in any conventional manner. The top surface of bottom arm 19 can be used to secure items such as clothing or jewelry by draping them over arm 19. Arm 19 has a long slot 20 extending therethrough and a pair of shorter slots 22, beneath slot 20, to hold skirts, socks, jewelry, nylons, and necklaces. Diamond shaped apertures 16, adjacent the junction between arms 18 and 19, can be used to store jewelry and to suspend the organizer upside down or vertically with two pedestal attachments if desired. Apertures 39 extend all along the bottom of the organizer to hold items such as earrings.

A wire 23 is secured to the bottom of the organizer at apertures 4 in any conventional manner. The wire 23 should be relatively rigid so items can be passed over the wire and then passed underneath arm 19 and then under aperture 20 or 22 to secure items such as envelopes which can contain items which can not be easily secured to the organizer in any other manner.

Figure 2:
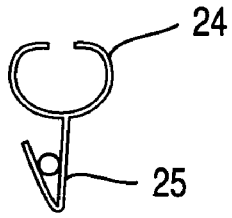
FIGS. 2 and 3 are side views of clips which can be used with the present invention.
Figure 3:
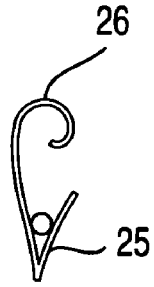

Also, clips, such as those shown in FIGS. 2 and 3 can be used to secure items to the organizer. An item can be passed into the open clip 24 and the resilient portion 25, similar to an alligator clip, can be used to resiliently grab a portion of the organizer 1 to hold the item to the organizer. The clip in FIG. 3 is similar to the clip in FIG. 2, but has a different shaped open clip 26. The open shaped clip 26 is more hook shaped than the clip 24. Alternatively, the clips of FIGS. 2 and 3 can be secured to the organizer by the portions 24, 26 and the resilient clip 25 can be used to grasp an item.

Figure 4:
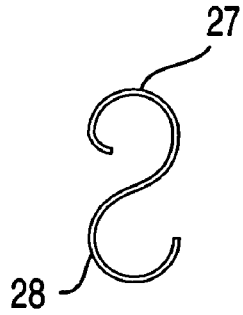
FIG. 4 is a side view of a hook that can be used with the present invention.
Figure 5:
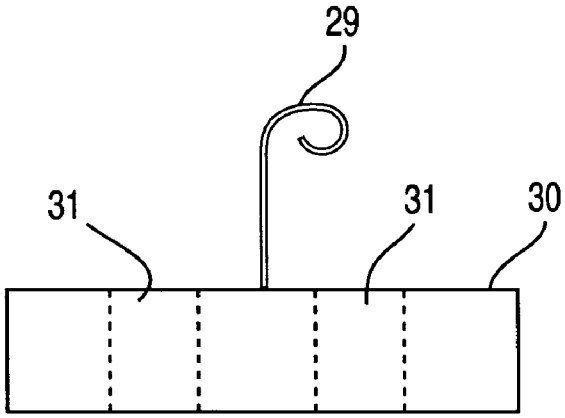
FIG. 5 is a side view of a container that can be used with the present invention.

FIG. 4 shows an S-shaped hook having a top hook 27 and a bottom hook 28 which can be used to hang items from the organizer 1. The carrier of FIG. 5 has a hook 29, similar to the hook 26 in FIG. 3. Attached to the hook 29 is a carrier body 30. The carrier body 30 has a plurality of compartments 31 which can be used to hold small items.

Figure 6:
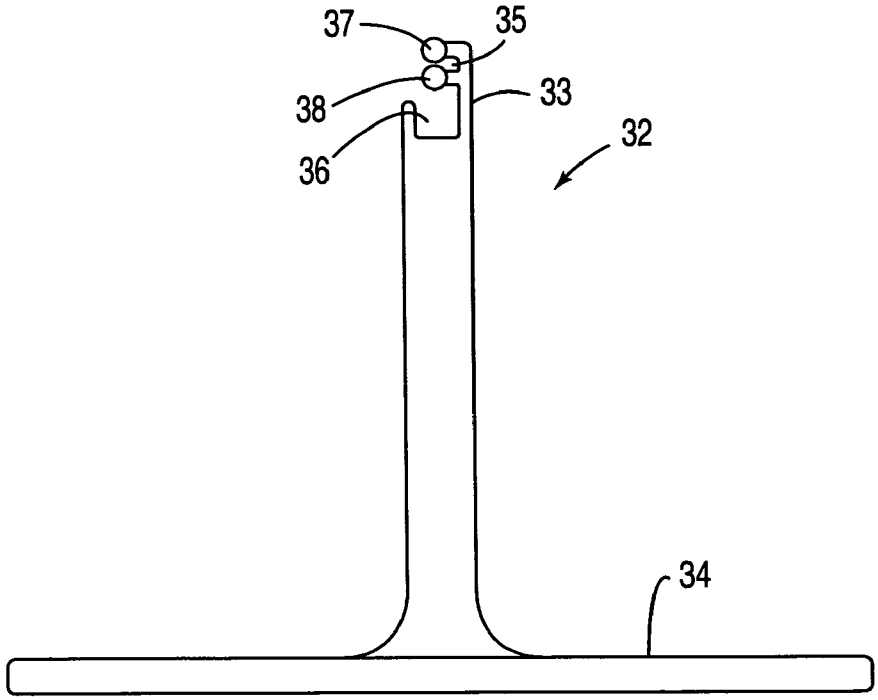
FIG. 6 is a side view of a stand that can be used with the present invention.
Figure 8:
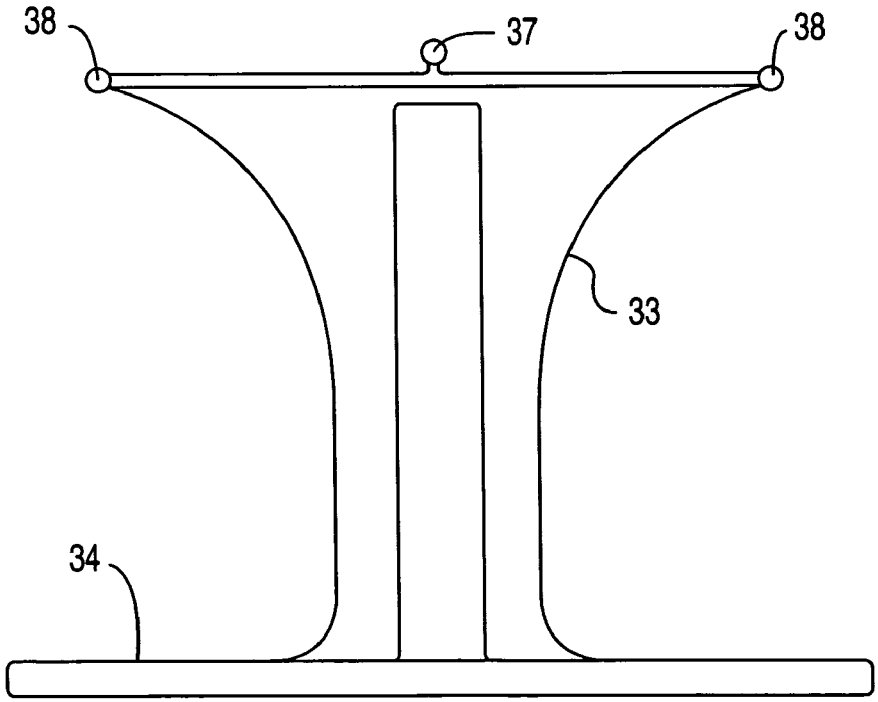
FIG. 8 is a front view of the stand of FIG. 6.

FIGS. 6 and 8 show a stand 32 that can be used to hold the invention on a horizontal surface such as, but not limited to a dresser. The stand 32 has a base 34 and a vertical portion 33 extending up from the base. The upper portion of portion 33 has a slot 35 extending horizontally into the vertical portion 33. A second slot 36 extends horizontally and then vertically into vertical portion 33. In order to hold the organizer of FIG. 1. The bottom of the organizer would be tilted into the slot 36 and the solid portion of the organizer above slot 20 would be pushed into slot 35 and then the organizer would be tilted toward the top of the stand 32 until the ball end 37 snaps into the aperture 4 and the ball ends 38 (only one of which is shown in FIG. 6) will snap into the slots 22. The diameters of the ball ends 37, 38 should be slightly larger than the aperture 4 and the slots 22. In addition, the stand could be made from a transparent material and lighted from inside (in any conventional manner) to serve as a night light.

Figure 7:
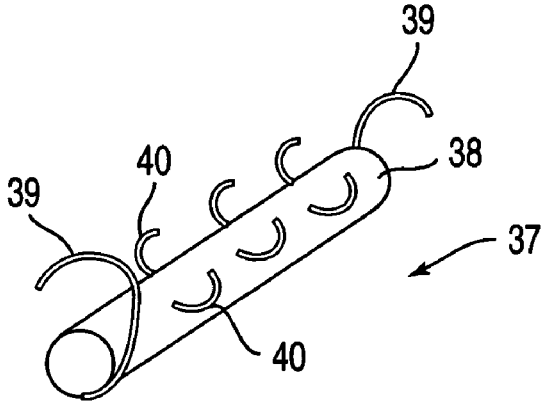
FIG. 7 is a perspective view of an accessory that can be used with the present invention.

FIG. 7 shows an accessory 37 that can be hung from the organizer of FIG. 1 to hold items such as, but not limited to, rings. The accessory has a body 38 which can be made in a variety of lengths. The body has a pair of mounting hooks 39 at opposite ends. The hooks 39 are curved to fit onto various portions of the FIG. 1 organizer such as, but not limited to, arms 21 or wire 23. The body 38 has a plurality of hooked shaped elements 40 which are secured to the body by any conventional means and extend from both sides of the body 38 to hold a variety of items.

Although the Victorian Eagle Organizer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An organizer for holding a variety of items in one location, said organizer comprising:

a body having a hook shaped upper portion, for hanging said organizer on a support, secured to an upper portion of said body, a neck portion between said hook shaped upper portion and said body, said neck portion having an aperture extending therethrough for receiving items, and wherein said body is formed by a pair of arms secured to a horizontal arm, and a second aperture on one of said pair of arms directly adjacent said aperture in said neck portion, and a third aperture on another of said pair of arms directly adjacent said aperture in said neck portion, and means extending from said second aperture across said aperture in said neck portion to said third aperture for securing items extending through said aperture in said neck portion, and wherein each of said pair of arms has a plurality of apertures extending therethrough.

2. The organizer as claimed in claim 1, wherein a storage compartment is adapted to be secured to said organizer, said storage compartment having means for securing said storage compartment to said organizer, and a body secured to said means, and said body has a plurality of compartments.

3. The organizer as claimed in claim 1, wherein said body is formed by a pair of sloping arms secured to a horizontal arm, and wherein each of said sloping arms has another arm extending above said sloping arms toward said hook shaped upper portion.

* * * * *